United States Patent [19]

Guala

[11] Patent Number: 4,458,817

[45] Date of Patent: Jul. 10, 1984

[54] CLOSURE WITH INTERNAL SECURITY FOR BOTTLES AND THE LIKE

[75] Inventor: Pier G. Guala, Alessandria, Italy

[73] Assignee: Angelo Guala S.p.A., Alessandria, Italy

[21] Appl. No.: 374,523

[22] Filed: May 3, 1982

[30] Foreign Application Priority Data

May 12, 1981 [IT] Italy ..... 21643 A/81

[51] Int. Cl.[3] ..... B65D 49/02

[52] U.S. Cl. ..... 215/21; 215/252; 215/262

[58] Field of Search ..... 215/21, 262, 252; 220/231; 251/251

[56] References Cited

U.S. PATENT DOCUMENTS

| | | | |
|---|---|---|---|
| 1,124,977 | 1/1915 | Uhlein | 215/21 |
| 2,076,668 | 4/1937 | Read | 215/21 |
| 2,378,919 | 6/1945 | Fisher | 215/21 |
| 2,380,825 | 7/1945 | Diaz | 215/21 |
| 2,395,470 | 2/1946 | Ewing | 251/251 |
| 4,147,181 | 4/1979 | Hashimoto | 251/251 |
| 4,232,795 | 11/1980 | Vigna | 215/21 |
| 4,377,242 | 3/1983 | Snedker | 215/21 |

*Primary Examiner*—Joseph Man-Fu Moy
*Assistant Examiner*—David Fidei
*Attorney, Agent, or Firm*—Birch, Stewart, Kolasch & Birch

[57] ABSTRACT

A closure with internal security for bottles and the like is described, which allows the contents to be immediately and freely poured from the bottle as soon as it is taken from a refrigerator, and therefore has a partial vacuum within it. This closure includes a body which is fixed to the mouth of the bottle and defines a fluid passage, a cap which can be screwed onto the body to close the passage, at least one valve shutter movable along the passage in the body to engage a valve seat in the passage, engagement means between the shutter and the cap for turning of the shutter by the cap as it is unscrewed, a cusp-shaped projection on the body facing the shutter, and a corresponding projection on the shutter for engaging and riding over the cusp-shaped projection upon unscrewing of the cap, to raise the shutter from the valve seat.

5 Claims, 2 Drawing Figures

CLOSURE WITH INTERNAL SECURITY FOR BOTTLES AND THE LIKE

BACKGROUND OF THE INVENTION

1. Field of the Invention

The present invention relates to a closure with internal security, for bottles and the like, of the type comprising a body fixable to the mouth of the bottle and defining a fluid passage, a cap for screwing onto the body to close the passage, and at least one valve shutter movable along the passage in the body to engage a valve seat in the passage.

2. Description of Background Art

Closures are known which are particularly intended for bottles of alcoholic liquors and highly-valued spirits which serve to prevent refilling of the bottle so that, once the original valuable contents have been consumed, the bottle cannot be refilled with liquor from a different source, for selling fraudulently as the original.

Although generally satisfying theses requirements, known closures of the specified type currently in use have a functional disadvantage which limits their use.

In particular, this disadvantage lies in the fact that, upon pouring, the desired flow of liquid from the bottle does not always occur. This disadvantage can be explained by the fact that, since the liquors are normally consumed cold, the bottle is usually placed in a refrigerator. Due to the cooling of the liquor and air contained in the bottle, and because of the presence in the closure of the shutter in engagement with its valve seat, a partial vacuum forms in the bottle which is as great as the difference between the temperature of the bottle when it is put into the refrigerator and the temperature within the refrigerator itself.

This partial vacuum prevents or impedes the separation of the valve shutter from the valve seat, resulting in the disadvantage.

SUMMARY AND OBJECT OF THE INVENTION

The problem behind the present invention is that of devising a closure of the specified type which offers the required security conditions and, at the same time, overcomes the disadvantage discussed above with reference to the prior art.

This problem is solved according to the present invention by a closure of the specified type, which includes engagement means between the valve shutter and the cap for turning the shutter as the cap is unscrewed, a cusp-shaped projection on the body facing towards the shutter, and a projection on the shutter for engaging and riding over the cusp-shaped projection upon unscrewing of the cap, to raise the shutter from the valve seat.

BRIEF DESCRIPTION OF THE DRAWINGS

Further characteristics and advantages of the closure according to the present invention will become apparent from the following detailed description of a preferred embodiment, which is given by way of example with reference to the attached drawings, in which.

DETAILED DESCRIPTION OF THE INVENTION

Figure 1:
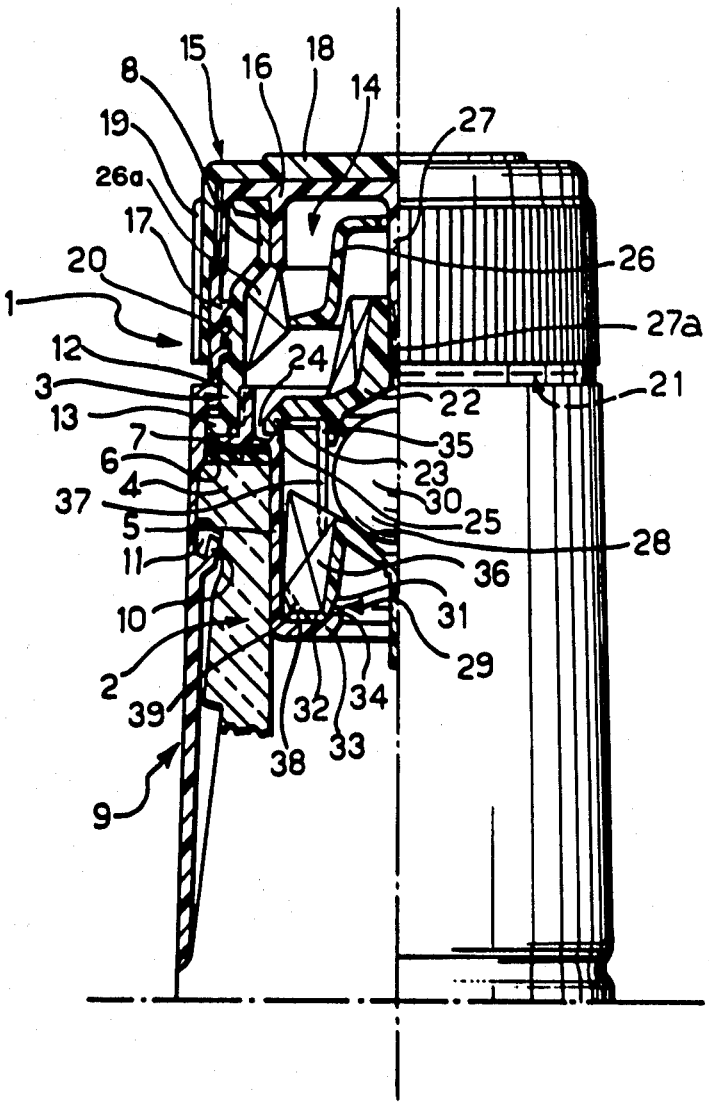
FIG. 1 is a partially-sectioned side view of a closure according to the invention.
Figure 2:
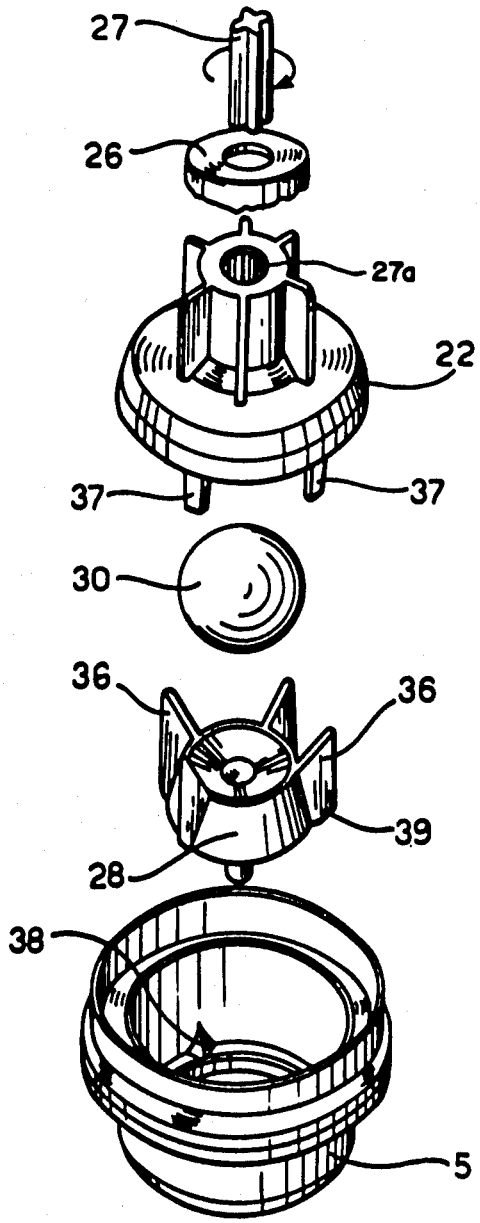
FIG. 2 is an exploded perspective view of a detail of FIG. 1.

With reference to the attached drawings, a closure with internal security, for a bottle 2, is generally indicated with the reference numeral 1. The closure 1 includes a body, generally indicated 3, which is fixed to the mouth 4 of the bottle 2. The body 3 is formed by a first sleeve 5 inserted within the mouth of the bottle 2 and abutting, with the interpositioning of a seal 7, against the rim 6 at the mouth of the bottle 2, a second sleeve 8 force-fitted over the first sleeve 5 as an extension thereof, and a third sleeve 9 which is press-fitted externally over the neck of the bottle 2 and is provided with a lip 10 snap-engaging a groove 11 formed on the neck of the bottle 2, as well as a flange 12 engaging from above a corresponding flange 13 of the second sleeve 8 to retain it in an engaged position on the first sleeve 5.

In the body 3, and in particular through the sleeves 8 and 5, there is defined a fluid passage 14. To close the said passage 14, the closure 1 includes a cap, generally indicated 15, which is constituted by a first inner cap 16 provided internally with female threading 17, and by a second outer cap 18 force-fitted to be frictionally retained relative to the first cap 16 and provided externally with knurling.

The cap 15 is screwed onto the aforesaid body 3, by means of the threading 17 which engages with a male thread 20 formed externally on the second sleeve 8. In an entirely conventional manner, the first cap 16 and the third sleeve 9 are initially formed in one piece and are separated upon first opening of the bottle by rending a ready-cut section 21 in the said one piece.

The closure 1 includes, along the said passage 14 and in a position immediately adjacent the cap 15 where the passage 14 extends towards the interior of the bottle 2, a bell-shaped body 22 having a free edge 23 which is inserted into an annular recess 24 defined in the sleeve 5 by an annular flange 25 formed in the sleeve 5 itself, and is fitted over the annular flange 25.

The bell-shaped body 22 is movable in the closure 1 along the passage 14 between a closure position in which the edge 23 is fitted over the flange 25, and an open position in which the free edge is spaced from the annular recess 24, and the bell-shaped body 22 abuts against the annular diaphragm 26 formed in the second sleeve 8. The annular diaphragm 26 is connected to the second sleeve 8 by means of radial ribs 26a.

A splined stem projects from the second cap 16 towards the interior of the bottle. The stem 27 extends through the annular diaphragm 26 and is movably engaged with limited friction in a corresponding splined recess 27*a* formed in the bell-shaped body 22.

In order to block the passage 14 in one direction, so as to prevent the ingress of liquid into the bottle and to allow only an outflow, the closure 1 further includes a valve shutter 28 positioned in the passage 14 immediately adjacent the bell-shaped body 22 along the passage in a direction towards the interior of the bottle 2.

The valve shutter 28 is movable in the closure 1 towards the interior of the bottle 2 to engage a valve seat 29, and towards the exterior for disengagement. The shutter 28 is subject to the weight of a ball 30 interposed between the bell-shaped body 22 and the valve shutter 28 itself. The valve shutter 28 is shaped like a bell and has the free edge 31 of the bell inserted in an annular groove 32 defined in the first sleeve 5 by its annular end portion 33 having a U-shaped section. The free edge 31 is sealingly fitted over the inner annular edge 34 of the annular end portion 33.

The closure 1 of the ivention includes engagement means, generally indicated 35, interposed between the valve shutter 28 and the cap 15 for turning of the shutter 28 by the cap 15 upon screwing of the latter. These means 35 include four ribs, all indicated 36, projecting radially from the shutter 28, four projections, all indicated 37, projecting down from the bell-shaped body 22 and inserted between the said ribs 36, as well as the splined coupling constituted by the stem 27 and the corresponding splined recess 27a.

The closure 1 of the invention further includes a cuspshaped projection 38 formed in the annular groove 32 and facing towards the shutter 28, as well as a projection 39 extending from the valve shutter 28, which is intended to engage the cusp-shaped projection 38 and to ride over it, raising the valve shutter 28 from its valve seat 29, upon unscrewing of the cap 15. Advantageously, a projection 39 is formed on each of the four radial ribs 36.

The operation of the closure according to the invention is described below with reference to an initial condition, such as is illustrated in FIG. 1, in which the bottle is closed. One should assume that the bottle has been just taken from the refrigerator for pouring and that, therefore, it has a partial vacuum within it. To pour out the contents from the bottle it is necessary first of all to unscrew the cap 15, obviously after having removed the collar 12 in the case of a closure which is still sealed.

During the unscrewing, the cap 15 separates from the body 3 and raises the bell-shaped body 22; due to the friction between the splined stem 27 and the splined recess 27a it simultaneously turns the bell-shaped body. The bell-shaped body 22, in turn, causes the valve shutter 28 to turn by virtue of the engagement of the projections 37 with the ribs 36. During the rotation of the shutter 28, at least one of the ribs 36 enters into engagement with the cusp-shaped projection 38 and rides over it. When this occurs, the valve shutter 28 is positively raised from the valve seat 29 so that the interior of the bottle is immediately brought up to the ambient pressure.

Having completely removed the cap, the bottle is tipped to effect the required pouring, which takes place with perfect regularity due to the fact that the valve shutter once the action of the partial vacuum has ceased, is no longer stuck on the valve seat and can move away from this freely when necessary.

When the bottle is empty, the closure according to the invention offers the inviolable property of preventing any fraudulently dishonest refilling. In fact, the valve shutter 28 on its own shuts off the passage of liquid towards the interior of the bottle, whilst the bell-shaped body 22 prevents tools, such as metal blades and the like, being used to raise the shutter itself from its valve seat.

The closure according to the invention has the main advantage of offering the required against any insertion of liquid into the interior, whilst simultaneously allowing, upon pouring out from the bottle, an immediate and copious flow of its contents even if the bottle has just been taken from a refrigerator.

I claim:

1. A closure with internal security for bottles and the like, comprising:

a tubular body including a first sleeve like portion and a second sleeve like portion, said first sleeve like portion being fitted inside a bottle neck whereas said second sleeve like portion extends axially outside a mouth of the bottle and being provided with a male thread on its external surface, said first sleeve like portion being further provided with an inner annular recess at one end thereof and with an inner radially extending portion at the other end which is inside the bottle neck, said inner radially extending portion including a plurality of radially spaced and upwardly extending cup-shaped projections, said second sleeve like portion being further provided with a coaxial cup-shaped diaphragm and with a plurality of radially extending spaced ribs connecting said diaphragm to the inner surface thereof, said cup-shaped diaphragm being provided also with a central aperture;

a rotatably and axially displaceable bell-shaped body located inside said tubular body, said bell-shaped body being provided with a free edge for engagement with said annular recess of the first sleeve like portion, with an upwardly projecting member to fit axially inside said cup-shaped diaphragm and with a plurality of radially spaced and axially extending projections opposite to said upwardly projecting member;

a splined central axial recess disposed inside said upwardly projecting member;

a removable cap fitted over said second sleeve like portion, said cap being provided with an inner radially extending female thread for a screw engagement with said male thread and with an inner axially extending splined stem to fit axially inside said splined axial recess;

a rotatably and axially displaceable valve shutter positioned inside said first sleeve like portion, said valve shutter comprising a conical seat and a hollow tubular axial extension projecting towards the inside of the bottle, the periphery of said conical seat being provided with a plurality of radially extending axial ribs, one axial end of said ribs being able to engage the free end of at least one of said axially extending projections of said bell-shaped body, the other axial end resting upon said radially extending portion of said first sleeve like portion; and a freely movable ball located between said conical seat of the valve shutter and said bell-shaped body.

2. A closure according to claim 1, and further including a projection disposed on said first sleeve for selective engagement with said valve shutter.

3. A closure according to claim 2, wherein rotation of said cap rotates said valve shutter for displacing said valve shutter relative to said first sleeve as said valve shutter engages said projection on said first sleeve.

4. A closure according to claim 1, wherein rotation of said cap displaces said bell-shaped body relative to said first sleeve.

5. A closure according to claim 1, wherein said axially extending projections of said bell-shaped body engage said valve shutter for selectively imparting rotation thereto.

* * * * *